US008523038B2

(12) United States Patent
Liao

(10) Patent No.: US 8,523,038 B2
(45) Date of Patent: Sep. 3, 2013

(54) ADJUSTING-FIXING ASSEMBLY FOR A STAPLE GUN

(75) Inventor: Ming-Ho Liao, Taichung (TW)

(73) Assignee: Testo Industry Corp., Taichung (TW)

( * ) Notice: Subject to any disclaimer, the term of this patent is extended or adjusted under 35 U.S.C. 154(b) by 314 days.

(21) Appl. No.: 13/118,722

(22) Filed: May 31, 2011

(65) Prior Publication Data

US 2012/0305624 A1 Dec. 6, 2012

(51) Int. Cl.
*B25C 7/00* (2006.01)

(52) U.S. Cl.
USPC ..... 227/142

(58) Field of Classification Search
USPC ..... 227/9, 107, 120, 119, 139, 142
See application file for complete search history.

(56) References Cited

U.S. PATENT DOCUMENTS 6,427,896 B1 * 8/2002 Ho et al. ..... 227/142
6,705,501 B2 * 3/2004 Miller et al. ..... 227/8
6,866,177 B1 * 3/2005 Chen ..... 227/142
6,959,850 B2 * 11/2005 Taylor et al. ..... 227/8
6,988,648 B2 * 1/2006 Taylor et al. ..... 227/142
7,055,729 B2 * 6/2006 Taylor et al. ..... 227/142
7,845,530 B2 * 12/2010 Schell et al. ..... 227/8
2002/0121540 A1 * 9/2002 Taylor et al. ..... 227/142
2005/0189390 A1 * 9/2005 Taylor et al. ..... 227/8

* cited by examiner

*Primary Examiner* — Alexandra Elve
*Assistant Examiner* — Andrew M Tecco
(74) *Attorney, Agent, or Firm* — patenttm.us

(57) ABSTRACT

An adjusting-fixing assembly for a staple gun has a sliding frame, an adjusting nut, a fixing arm and an abutting shaft. The sliding frame is movably connected to the staple gun and has a connecting board with two positioning recesses. The adjusting nut is rotatably mounted on the sliding frame and has an engaging segment. The engaging segment is formed on the adjusting nut between the threaded end and the connecting board and has multiple engaging faces. The fixing arm is rotatably connected to the sliding frame, engages with the adjusting nut and has a connecting rod, an engaging recess and a positioning element. The engaging recess is formed in an inner side of the fixing nut and engages with two adjacent engaging faces of the engaging segment. The abutting shaft is connected to the adjusting nut and is movably connected to the staple gun.

8 Claims, 5 Drawing Sheets

ADJUSTING-FIXING ASSEMBLY FOR A STAPLE GUN

BACKGROUND OF THE INVENTION

1. Field of the Invention

The present invention relates to an adjusting-fixing assembly, and more particularly relates to an adjusting-fixing assembly for a staple gun that can hold an adjusting nut of the adjusting-fixing assembly securely when the staple gun is used and can provide a preferred quality of construction to the staple gun.

2. Description of Related Art

Conventional staple guns are used extensively with decorations, shoemaking and leatherwear and drives staples into objects and each conventional staple gun has an adjusting assembly mounted on a muzzle of the conventional staple gun to adjust the depth of a staple of the staple gun inserted into objects. The conventional adjusting assembly has a sliding frame, an adjusting nut and an abutting shaft. The sliding frame is movably connected to a side of the conventional staple gun, extends forward to the muzzle of the conventional staple gun and has a front end. The abutting nut is rotatably mounted on the front end of the sliding frame. The abutting shaft is U-shaped, is connected to the adjusting nut and the conventional staple gun ahead the muzzle and has two ends. One of the ends of the abutting shaft is mounted in and screwed with the adjusting nut and the other end of the abutting shaft is slidably connected to the conventional staple gun.

In use, before the conventional staple gun ejects staple into an object, a user can rotate the adjusting nut to enable the abutting shaft to move forward or backward relative to the muzzle of the conventional staple gun to adjust the depth of the staple of the staple gun inserted into objects or walls. When the conventional staple gun ejects a staple into an object, the abutting shaft abuts an external surface of the object to confirm the depth of the staple inserted into the object. However, the conventional staple gun will produce a vibration during the staple ejected into the object and the vibration will transmit to the adjusting nut via the abutting shaft to enable the adjusting nut to rotate relative to the abutting shaft and this will change the depth of the staple inserted into the object and cannot provide a preferred quality of construction to the staple gun.

To overcome the shortcomings, the present invention provides an adjusting-fixing assembly for a staple gun to mitigate or obviate the aforementioned problems.

SUMMARY OF THE INVENTION

The main objective of the present invention is to provide an adjusting-fixing assembly for a staple gun that can hold an adjusting nut of the adjusting-fixing assembly securely when the staple gun is used and can provide a preferred quality of construction to the staple gun.

The adjusting-fixing assembly for a staple gun having two opposite sides, a front end and a muzzle in accordance with the present invention has a sliding frame, an adjusting nut, a fixing arm and an abutting shaft. The sliding frame is movably connected to one of the opposite sides of the staple gun, extends forward to the muzzle and has a connecting board with two positioning recesses. The adjusting nut is rotatably mounted on the sliding frame and has a mounting end, a threaded end and an engaging segment. The engaging segment is formed on the adjusting nut between the threaded end and the connecting board and has multiple engaging faces. The fixing arm is rotatably connected to the sliding frame, engages with the adjusting nut and has a connecting rod, an engaging recess and a positioning element. The engaging recess is formed in an inner side of the fixing nut and engages with two adjacent engaging faces of the engaging segment. The abutting shaft is connected to the adjusting nut and is movably connected to the opposite sidewall of the staple gun that is opposite to the adjusting nut.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
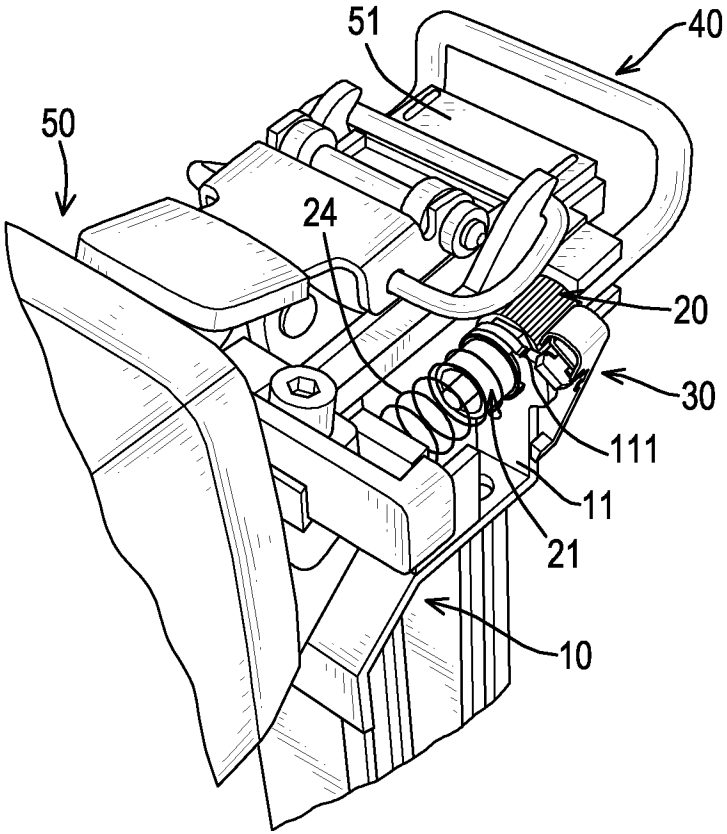
FIG. 1 is a perspective view of an adjusting-fixing assembly for a staple gun in accordance with the present invention, shown mounted on a staple gun.
Figure 2:
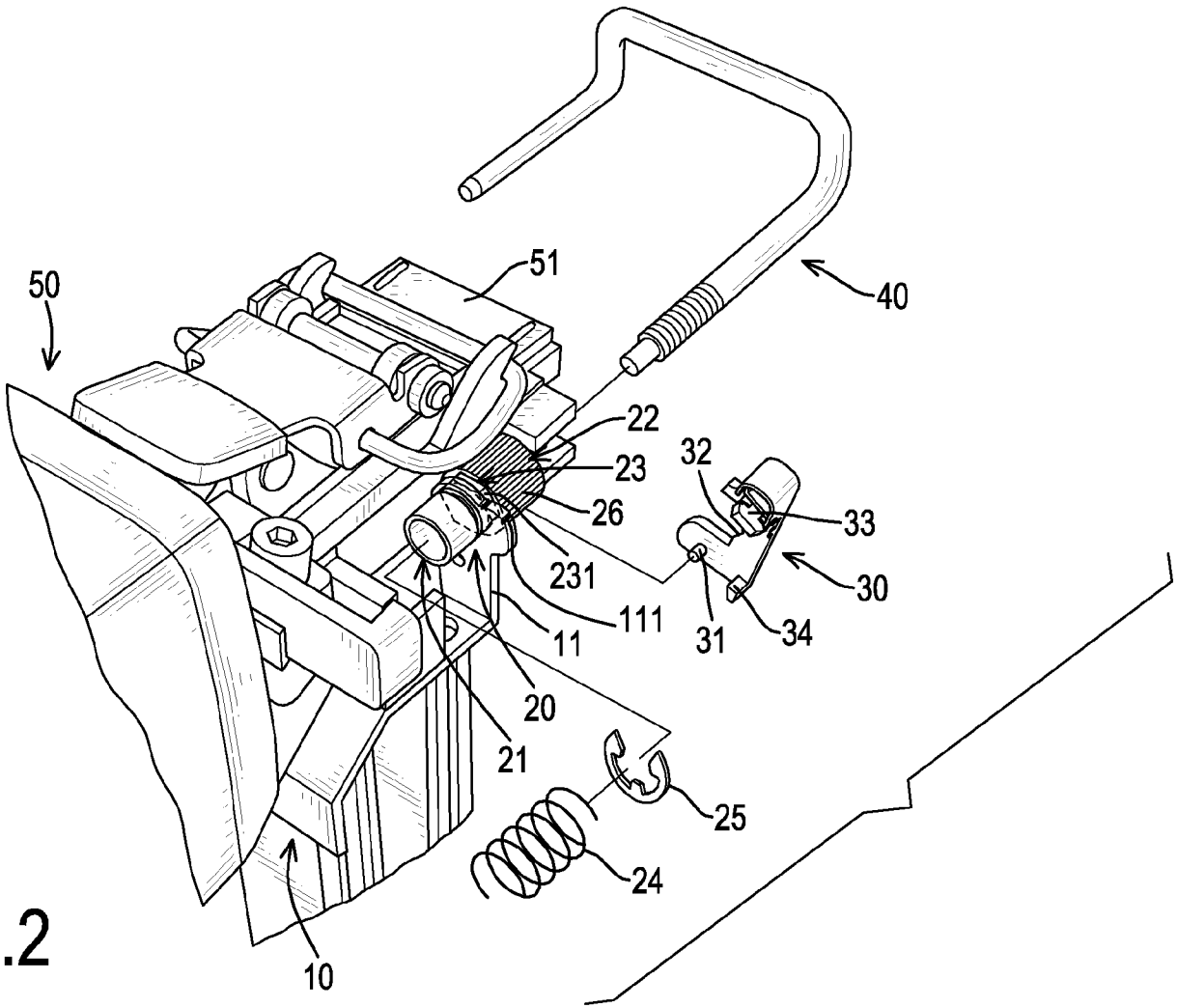
FIG. 2 is an exploded perspective view of the adjusting-fixing assembly and the staple gun in FIG. 1.
Figure 3:
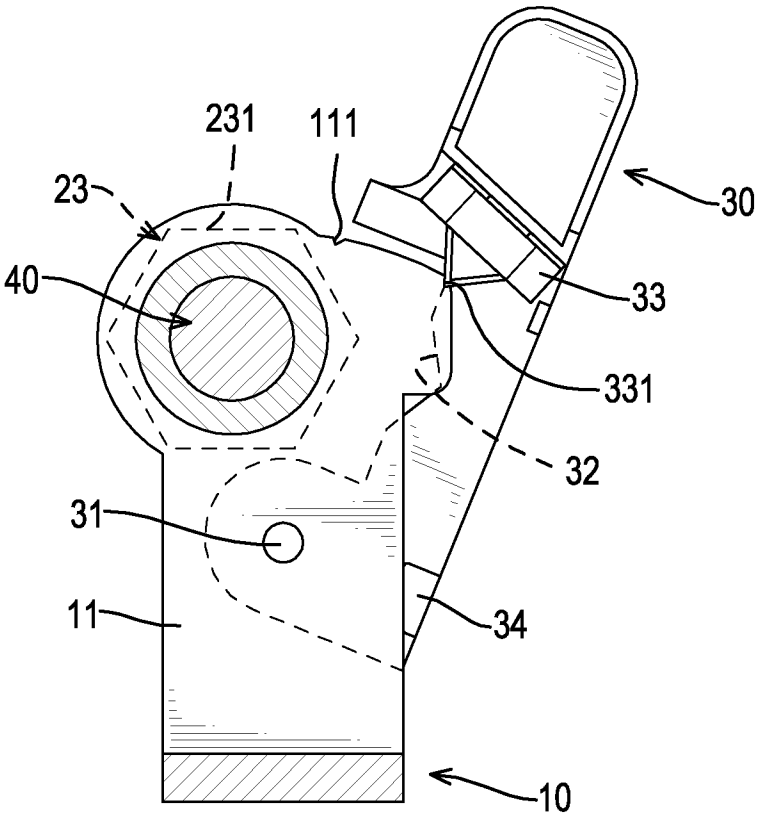
FIG. 3 is an operational side view in partial section of the adjusting-fixing assembly mounted in the staple gun in FIG. 1.
Figure 4:
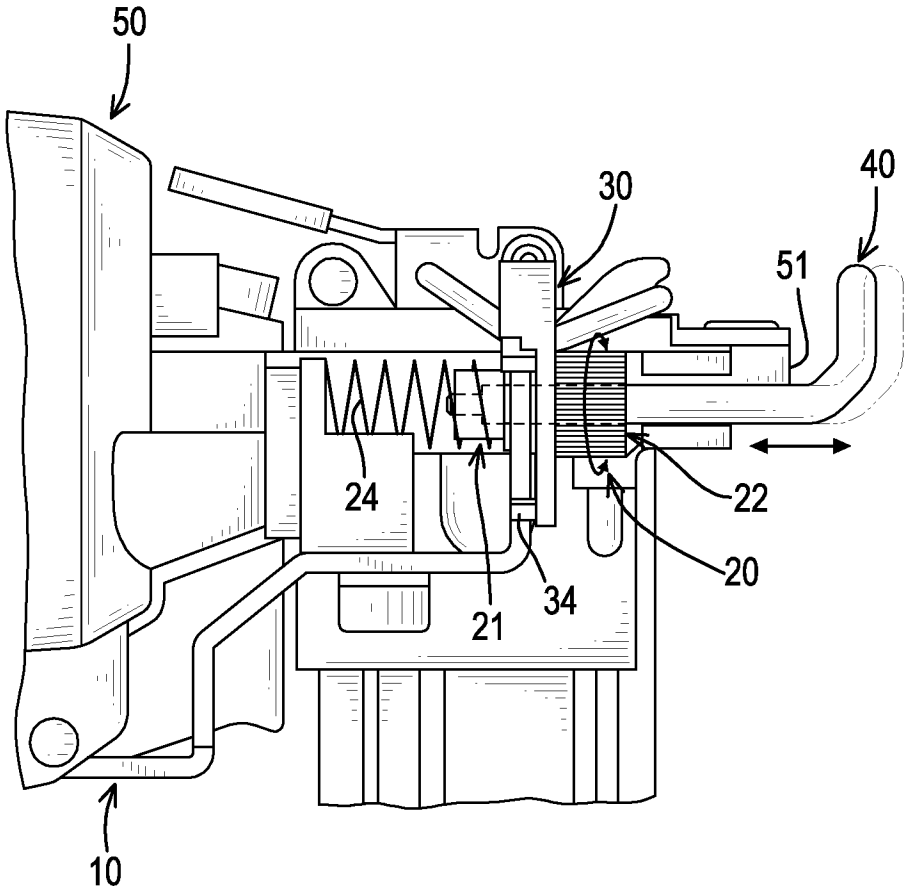
FIG. 4 is another operational side view of the adjusting-fixing assembly mounted in the staple gun in FIG. 1.

With reference to FIGS. 1 to 3, an adjusting-fixing assembly in accordance with the present invention is mounted on a staple gun 50 having two opposite sides, a front end and a muzzle 51 and the adjusting-fixing assembly comprises a sliding frame 10, an adjusting nut 20, a fixing arm 30 and an abutting shaft 40.

The muzzle 51 is formed in the front end of the staple gun 50 to eject staples out of the staple gun 50.

The sliding frame 10 is movably connected to one of the opposite sides of the staple gun 50, extends forward to the muzzle 51 of the staple gun 50 and has a rear end, a front end and a connecting board 11. The rear end of the sliding frame 10 is movably connected to the staple gun 50. The front end of the sliding frame 10 extends forward to the muzzle 51 of the staple gun 50. The connecting board 11 is formed on and protrudes from the front end of the sliding frame 10 and has an arc sidewall and two positioning recesses 111. The positioning recesses 111 are formed on the arc sidewall of the connecting board 11 at an interval.

The adjusting nut 20 is rotatably mounted on the sliding frame 10 and has an external surface, a mounting end 21, a threaded end 22, an engaging segment 23 and a spring 24.

The mounting end 21 of the adjusting nut 20 may be a cylinder, is rotatably connected to the connecting board 11 of the sliding frame 10 and extends backward to the rear end of the sliding frame 10. Preferably, the adjusting nut 20 has a C-ring 25 mounted around the external surface of the adjusting nut 20 between the ends 21, 22 to hold the adjusting nut 20 rotatably on the connecting board 11 of the sliding frame 10. The threaded end 22 of the adjusting nut 20 is formed with the mounting end 21 of the adjusting nut 20 and extends forward to the muzzle 51 of the staple gun 50. Preferably, the adjusting nut 20 has an indent 26 formed around the external surface of the adjusting nut 20 at the threaded end 22 of the adjusting nut 20.

The engaging segment 23 is formed on the external surface of the adjusting nut 20 between the threaded end 22 of the adjusting nut 20 and the connecting board 11 of the sliding frame 10 and has an external surface and multiple engaging faces 231. The engaging faces 231 are continuously formed around the external surface of the engaging segment 23 to form a noncircular engaging segment 23. The spring 24 is mounted around the mounting end 21 of the adjusting nut 20 and abuts the external surface of the staple gun 50 to provide a returning force to the sliding frame 10.

The fixing arm 30 is rotatably connected to the sliding frame 10, engages with the adjusting nut 20 and has a bottom end, a top end, a rear side, a front side, an inner side, a connecting rod 31, an engaging recess 32, a positioning element 33 and a limiting block 34. The connecting rod 31 is formed on and protrudes from the rear side of the fixing arm 30 near the bottom end of the fixing arm 30 and is rotatably connected to the connecting board 11 below the engaging segment 23 of the adjusting nut 20 to enable the fixing arm 30 to rotate relative to the adjusting nut 20 and the sliding frame 10 and to the inner side of the fixing arm 30 to face the engaging segment 23 of the adjusting nut 20.

The engaging recess 32 is formed in the inner side of the fixing nut 30 and engages with two adjacent engaging faces 231 of the engaging segment 23. The positioning element 33 is formed on and protrudes from the rear side of the fixing arm 30 near the top end of the fixing arm 30 above the arc sidewall of the connecting board 11 and has a lower end and a positioning protrusion 331. The positioning protrusion 331 is formed on the lower end of the positioning element 33 and selectively engages with one of the positioning recesses 111 of the connecting board 11 to hold the fixing arm 30 with the sliding frame 10. The limiting block 34 is formed on and protrudes from the rear side of the fixing arm 30 opposite to the connecting rod 31 and selectively abuts the connecting board 11 of the sliding frame 10.

The abutting shaft 40 may be U-shaped, is connected to the adjusting nut 20 and is movably connected to the opposite sidewall of the staple gun that is opposite to the adjusting nut 20 and has two ends. One of the ends of the abutting shaft 40 is mounted in and screwed with the threaded end 22 of the adjusting nut 20 and the other end of the abutting shaft 40 is movably connected to the opposite sidewall of the staple gun that is opposite to the adjusting nut 20 and abuts the external surface of the staple gun 50.

With reference to FIG. 3, when a user wants to adjust the depth of a staple of the staple gun 50 inserted into objects of a staple gun 50 that has the adjusting-fixing assembly in accordance with the present invention. First the user can use the connecting rod 31 as a pivot to turn the top end of the fixing arm 30 outwardly to enable the fixing arm 30 to rotate relative to sliding frame 10 and separating from the adjusting nut 20. When the fixing arm 30 separates from the adjusting nut 20, the positioning protrusion 331 of the positioning element 33 will engage with the lateral positioning recess 111 of the connecting board 11 to hold the fixing arm 30 with the sliding frame 10 and the limiting block 34 will abut with the sliding frame 10 to prevent the fixing arm 30 from over-rotating.

According to the above-mentioned operation, the engaging recess 32 of the fixing arm 30 will disengage with engaging faces 231 of the engaging segment 23. Then, the user can rotate the adjusting nut 20 rotating relative to the connecting board 11 of the sliding frame 10 by pushing the indent 26 on the external surface of the adjusting nut 20 to enable the abutting shaft 40 to move forward or backward relative to the muzzle 51 of the staple gun 50 and the depth of the staple inserted into objects can be set easily and conveniently by the adjusting-fixing assembly in accordance with the present invention.

Figure 5:
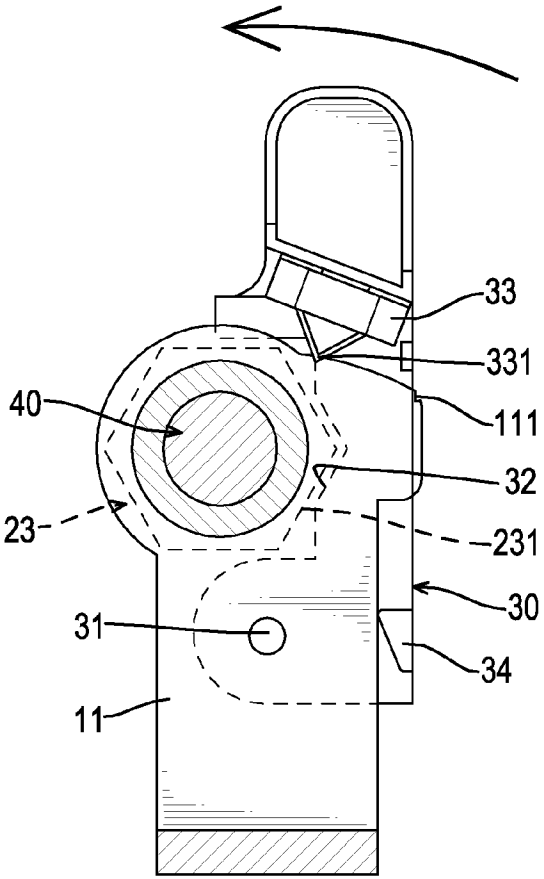
FIG. 5 is further operational side view in partial section of the adjusting-fixing assembly mounted in the staple gun in FIG. 1.

After adjusting the depth of the staple inserted into objects, with reference to FIG. 5, the user needs to push the fixing arm 30 back to the original position to enable the engaging recess 32 to engage securely with two adjacent engaging faces 231 of the noncircular engaging segment 23 and to enable the positioning protrusion 331 to engage with the other positioning recess 11 of the connecting board 11. Then, the fixing arm 30 can be engaged securely with the adjusting nut 20 by the engagement between the engaging recess 32, the engaging face 231, the positioning recess 111 and the positioning protrusion 331 to prevent the adjusting nut 20 from rotating relative to the sliding frame 10. Therefore, the vibration that produced by the staple gun 50 during the staple ejecting into the object cannot make the adjusting nut 20 rotating relative to the sliding frame 10 and the depth of the staple inserted into the object will not be changed by the vibration of the staple gun 50 and this can provide a preferred quality of construction to the staple gun 50.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. An adjusting-fixing assembly for a staple gun having two opposite sides, a front end and a muzzle formed in the front end of the staple gun and the adjusting-fixing assembly comprising a sliding frame being adapted to movably connect to one of the opposite sides of the staple gun to extend forward to the muzzle of the staple gun and having a rear end being adapted to movably connect to the staple gun;

a front end extending forward to the muzzle of the staple gun; and a connecting board formed on and protruding from the front end of the sliding frame and having an arc sidewall; and two positioning recesses formed on the arc sidewall of the connecting board at an interval;

an adjusting nut rotatably mounted on the sliding frame and having an external surface;

a mounting end rotatably connected to the connecting board of the sliding frame and extending backward to the rear end of the sliding frame;

a threaded end formed with the mounting end of the adjusting nut and extending forward to the muzzle of the staple gun; and an engaging segment formed on the external surface of the adjusting nut between the threaded end of the adjusting nut and the connecting board of the sliding frame and having an external surface; and multiple engaging faces continuously formed around the external surface of the engaging segment to form a noncircular engaging segment;

a fixing arm rotatably connected to the sliding frame, engaging with the adjusting nut and having a bottom end;

a top end;
a rear side;
a front side;
an inner side;
a connecting rod formed on and protruding from the rear side of the fixing arm near the bottom end of the fixing arm and rotatably connected to the connecting board below the engaging segment of the adjusting nut to enable the fixing arm to rotate relative to the adjusting nut and the sliding frame and to enable the inner side of the fixing arm to face the engaging segment of the adjusting nut;
an engaging recess formed in the inner side of the fixing nut and engaging with two adjacent engaging faces of the engaging segment; and
a positioning element formed on and protruding from the rear side of the fixing arm near the top end of the fixing arm above the arc sidewall of the connecting board and having
a lower end; and
a positioning protrusion formed on the lower end of the positioning element and selectively engaging with one of the positioning recesses of the connecting board to hold the fixing arm with the sliding frame; and
an abutting shaft connected to the adjusting nut, being adapted to movably connect to the opposite sidewall of the staple gun that is opposite to the adjusting nut and having two ends, one of the ends of the abutting shaft mounted in and screwed with the threaded end of the adjusting nut and the other end of the abutting shaft being adapted to movably connect to the opposite sidewall of the staple gun that is opposite to the adjusting nut and to abut with the external surface of the staple gun.

2. The adjusting-fixing assembly for a staple gun as claimed in claim 1, wherein the adjusting nut has a C-ring mounted around the external surface of the adjusting nut between the mounting end and the threaded end of the adjusting nut to hold the adjusting nut rotatably on the connecting board of the sliding frame.

3. The adjusting-fixing assembly for a staple gun as claimed in claim 2, wherein the adjusting nut has an indent formed around the external surface of the adjusting nut at the threaded end of the adjusting nut.

4. The adjusting-fixing assembly for a staple gun as claimed in claim 3, wherein the adjusting nut has a spring mounted around the mounting end of the adjusting nut to abut with the external surface of the staple gun.

5. The adjusting-fixing assembly for a staple gun as claimed in claim 4, wherein the fixing arm has a limiting block formed on and protruding from the rear side of the fixing arm opposite to the connecting rod and selectively abutting the connecting board of the sliding frame.

6. The adjusting-fixing assembly for a staple gun as claimed in claim 1, wherein the adjusting nut has an indent formed around the external surface of the adjusting nut at the threaded end of the adjusting nut.

7. The adjusting-fixing assembly for a staple gun as claimed in claim 1, wherein the adjusting nut has a spring mounted around the mounting end of the adjusting nut to abut with the external surface of the staple gun.

8. The adjusting-fixing assembly for a staple gun as claimed in claim 1, wherein the fixing arm has a limiting block formed on and protruding from the rear side of the fixing arm opposite to the connecting rod and selectively abutting the connecting board of the sliding frame.

* * * * *